US007013110B1

(12) United States Patent
Carpenter et al.

(10) Patent No.: US 7,013,110 B1
(45) Date of Patent: Mar. 14, 2006

(54) RADIO RECEIVER APPARATUS FOR CONCURRENT RECEPTION OF VOICE AND RELATED INFORMATION

(75) Inventors: Kenneth Scott Carpenter, Rowlett, TX (US); Arthur Y. Tsubaki, Keller, TX (US)

(73) Assignee: Uniden American Corporation, Fort Worth, TX (US)

( * ) Notice: Subject to any disclaimer, the term of this patent is extended or adjusted under 35 U.S.C. 154(b) by 546 days.

(21) Appl. No.: 10/192,477

(22) Filed: Jul. 10, 2002

(51) Int. Cl.
*H04H 7/00* (2006.01)

(52) U.S. Cl. ..... 455/3.06; 455/3.01; 455/344

(58) Field of Classification Search ..... 455/3.01, 455/3.03, 3.04, 3.06, 553.1, 517, 344, 345
See application file for complete search history.

(56) References Cited

U.S. PATENT DOCUMENTS

| | | | | |
|---|---|---|---|---|
| 5,513,384 | A * | 4/1996 | Brennan et al. | 455/180.1 |
| 5,758,313 | A | 5/1998 | Shah et al. | 701/208 |
| 5,946,635 | A * | 8/1999 | Dominguez | 455/558 |
| 6,195,090 | B1 * | 2/2001 | Riggins, III | 725/139 |
| 6,650,903 | B1 * | 11/2003 | Inselberg | 455/517 |
| 6,678,501 | B1 * | 1/2004 | Valeski | 455/3.04 |
| 2002/0115454 | A1 * | 8/2002 | Hardacker | 455/457 |
| 2002/0138587 | A1 * | 9/2002 | Koehler et al. | 709/207 |
| 2003/0100259 | A1 * | 5/2003 | Sinclair | 455/3.01 |
| 2003/0104830 | A1 * | 6/2003 | Norwood et al. | 455/517 |

OTHER PUBLICATIONS

Uniden® Bearcat® SC200 200-Channel Programmable Twin Turbo Hand-Held Sports Scanner Operating Guide (© 1999 Uniden America Corporation) (57 pages and cover page).

(Continued)

*Primary Examiner*—Quochien B. Vuong
*Assistant Examiner*—Lewis West
(74) *Attorney, Agent, or Firm*—Sidley Austin Brown & Wood LLP

(57) ABSTRACT

A radio receiving apparatus is used at a sporting event to provide a spectator with additional information and contact with the participants in the event. In an automobile racing event, each of the automobiles can be equipped with a two-way radio for communication between the driver and the crew as well as with a telemetry transmitter for sending data concerning the operation of the automobile. The telemetry data is combined with other information relating to the car's involvement in the race and this data is combined to produce parameter data. A hand-held receiver receives both the audio conversation and the parameter data for one of the selected cars and produces audible sounds and concurrently produces a display of a graphic image on a screen with information derived from the parameter data. Thus, the user of the receiving apparatus can both hear a selected driver and at the same time see a display of performance information about the car and driver in the race. The receiving apparatus can comprise either two radio receivers, one for the audio signal and the other for the data signal, or a single receiver that receives a combined audio and data signal that is separated within the receiver to produce the separate audible and graphic displays. Before the sporting event commences, an electronic file can be automatically loaded into the receiving apparatus to preprogram the apparatus with all of the frequencies for the participants, thus allowing the user to easily select and move between the participants to more fully participate in the sporting event. The receiving apparatus can be a stand alone unit or a module used with a portable electronic display such as a personal digital assistant.

25 Claims, 10 Drawing Sheets

OTHER PUBLICATIONS

"Novatel Wireless Palmtop Modems" "Handheld Modems"; (a) "Minstrel m500™",(b) "Minstrel 540™" (c) "Minstrel S™"; (d) "Minstrel V™"; (e) "Minstrel III™", (http://www.novatelwireless.com/palmtop/index.html, Novatel Wireless, Inc. online brochure pages downloaded Mar. 27, 2002, copyright 2001, (2 pages).

"Wireless Modem for the Palm m500 Series Handhelds", "Minstrel m500™" http://www.novatelwireless.com/palmtop/minstrelm_500.html, Novatel Wireless, Inc. online brochure pages downloaded Mar. 27, 2002, copyright 2001 (3 pages).

"Novatel Wireless Palmtop for HP Jornada Minstrel 540" "Minstrel 540™" http://www.novatelwireless.com/palmtop/minstrel540.html, Novatel Wireless, Inc. online brochure pages downloaded Mar. 27, 2002, copyright 2001 (3 pages).

"Novatel Wireless Palmtop for Handspring Visor Minstrel S"; "Minstrel S™", as disclosed on http://www.novatelwireless.com/palmtop/minstrelS.html, Novatel Wireless, Inc. online brochure pages downloaded Mar. 27, 2002, copyright 2001 (3 pages).

"Novatel Wireless Minstrel III, Palm III Modem", "Minstrell III™", as disclosed on http://www.novatelwireless.com/palmtop/minstrel3.html, Novatel Wireless, Inc. online brochure pages downloaded Mar. 27, 2002, copyright 2001 (3 pages).

"Novatel Wireless Minstrel V, Wireless Modemfor Palm V", as disclosed on http://www.novatelwireless.com/palmtop/minstrel5.html, Novatel Wireless, Inc. online brochure pages downloaded Mar. 27, 2002, copyright 2001 (3 pages).

"NAVMAN Hardware GPS3000", "The NAVMAN MOBILE GPS system for the iPAQ 3000 Series Pocket PC", as disclosed on http://www.navman-mobile.com/tml/3000.htm, NAVMAN Mobile Limited online brochure pages downloaded Mar. 27, 2002, copyright 2001 (2 pages).

"FlashDR", "LANDmark™" FlashDR™ as disclosed on http://www.om2k.com/products/flashdr.htm, Sullivan & Associates Limited online brochure pages downloaded Mar. 27, 2002, copyright 1993-2001 (2 pages).

* cited by examiner

40

42
MEMORY
56
65
INPUT PORT
MICROPROCESSOR
54
TUNABLE RECEIVER
60
46
KEYPAD
TUNABLE RECEIVER
58
44
DISPLAY SCREEN
DECODER
62
48
SPEAKER
AMPLIFIER
64
66
HEADSET JACK 290
294
MEMORY
296
292
MICROPROCESSOR
TUNABLE RECEIVER
298
DECODER
300
310
COMMUNICATION PORT
D/A CONVERTER
AMPLIFIER
304
302
312
CONNECTOR
HEADSET JACK
306
232
226
228
256
212
230

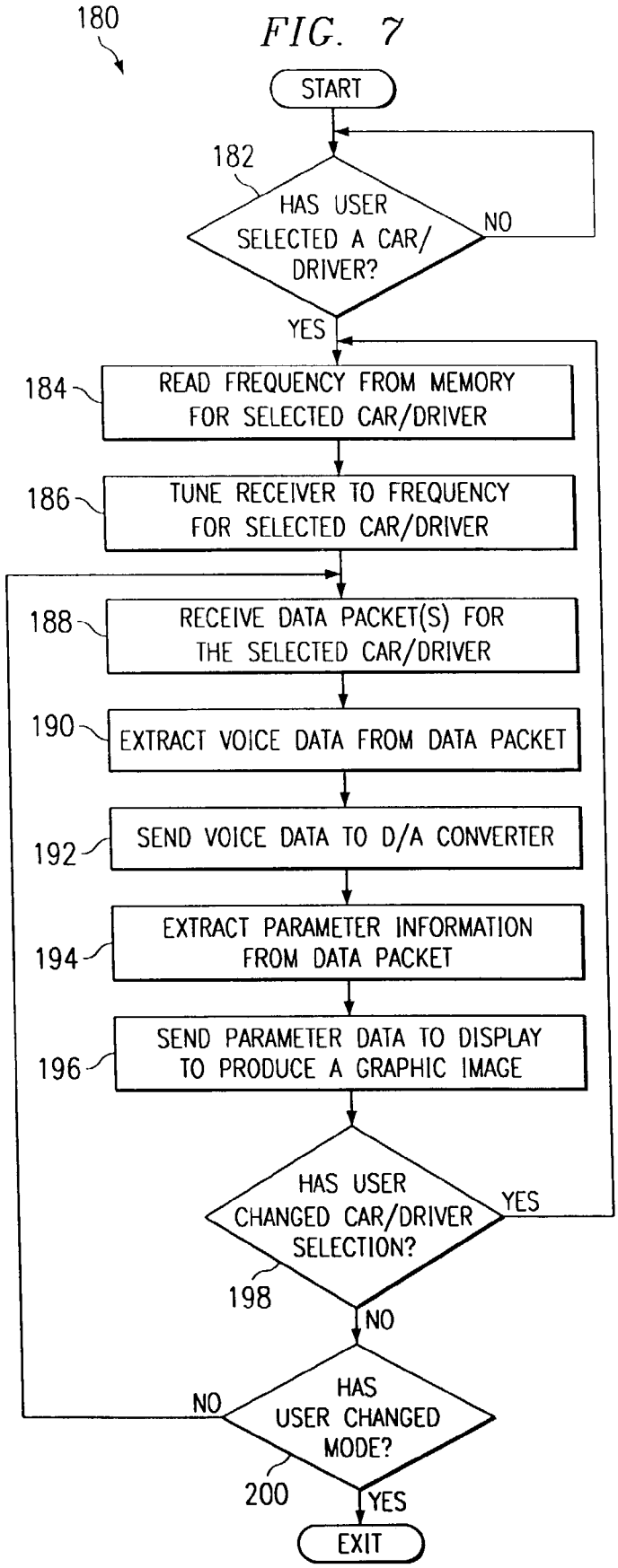
180
FIG. 7
START
182
HAS USER SELECTED A CAR/ DRIVER?
NO
YES
184
READ FREQUENCY FROM MEMORY FOR SELECTED CAR/DRIVER
186
TUNE RECEIVER TO FREQUENCY FOR SELECTED CAR/DRIVER
188
RECEIVE DATA PACKET(S) FOR THE SELECTED CAR/DRIVER
190
EXTRACT VOICE DATA FROM DATA PACKET
192
SEND VOICE DATA TO D/A CONVERTER
194
EXTRACT PARAMETER INFORMATION FROM DATA PACKET
196
SEND PARAMETER DATA TO DISPLAY TO PRODUCE A GRAPHIC IMAGE
HAS USER CHANGED CAR/DRIVER SELECTION?
YES
198
NO
HAS USER CHANGED MODE?
NO
200
YES
EXIT

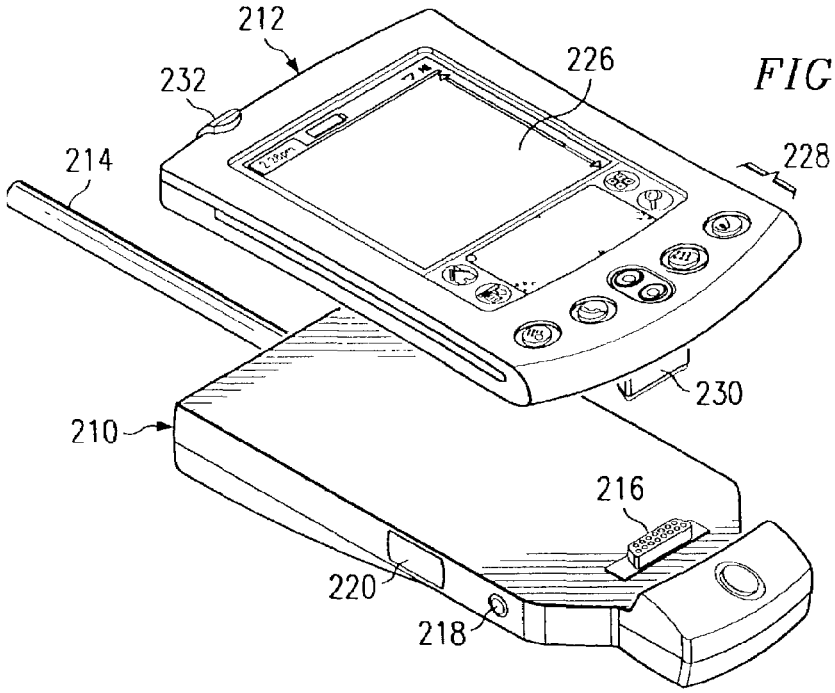
FIG. 8
FIG. 9
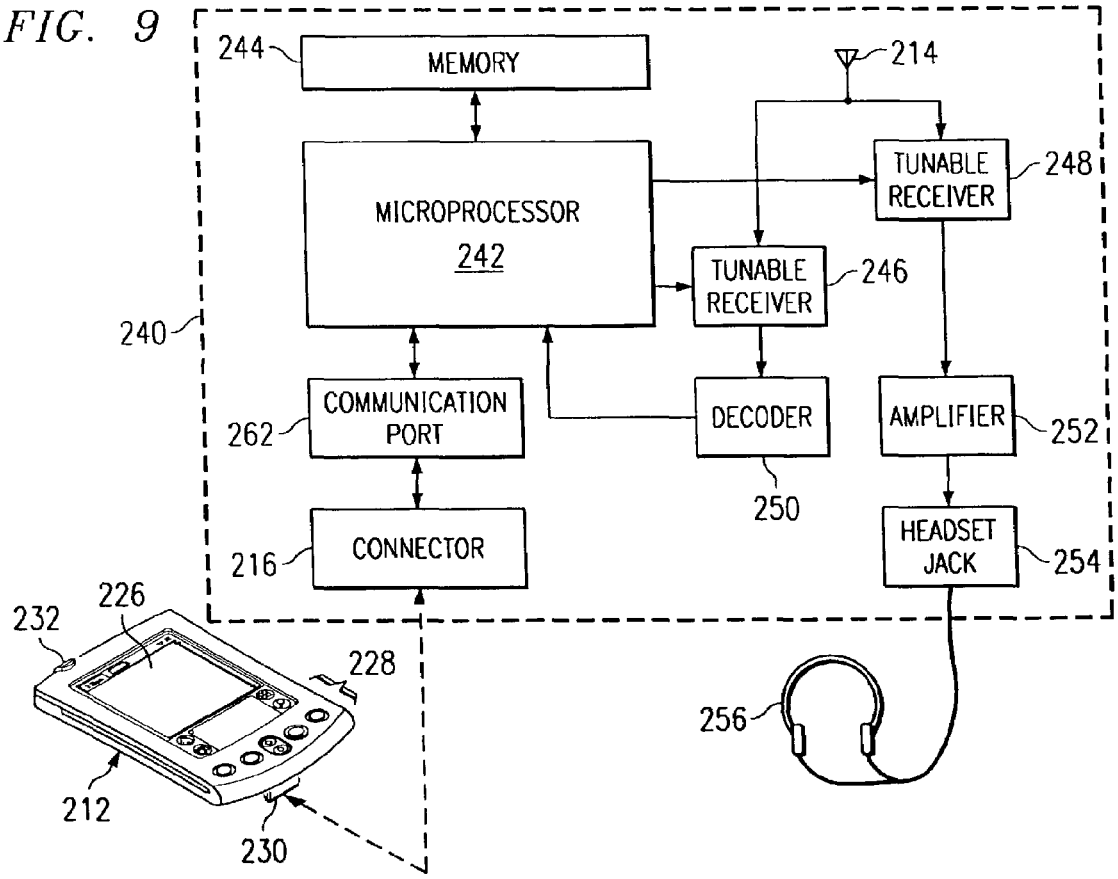

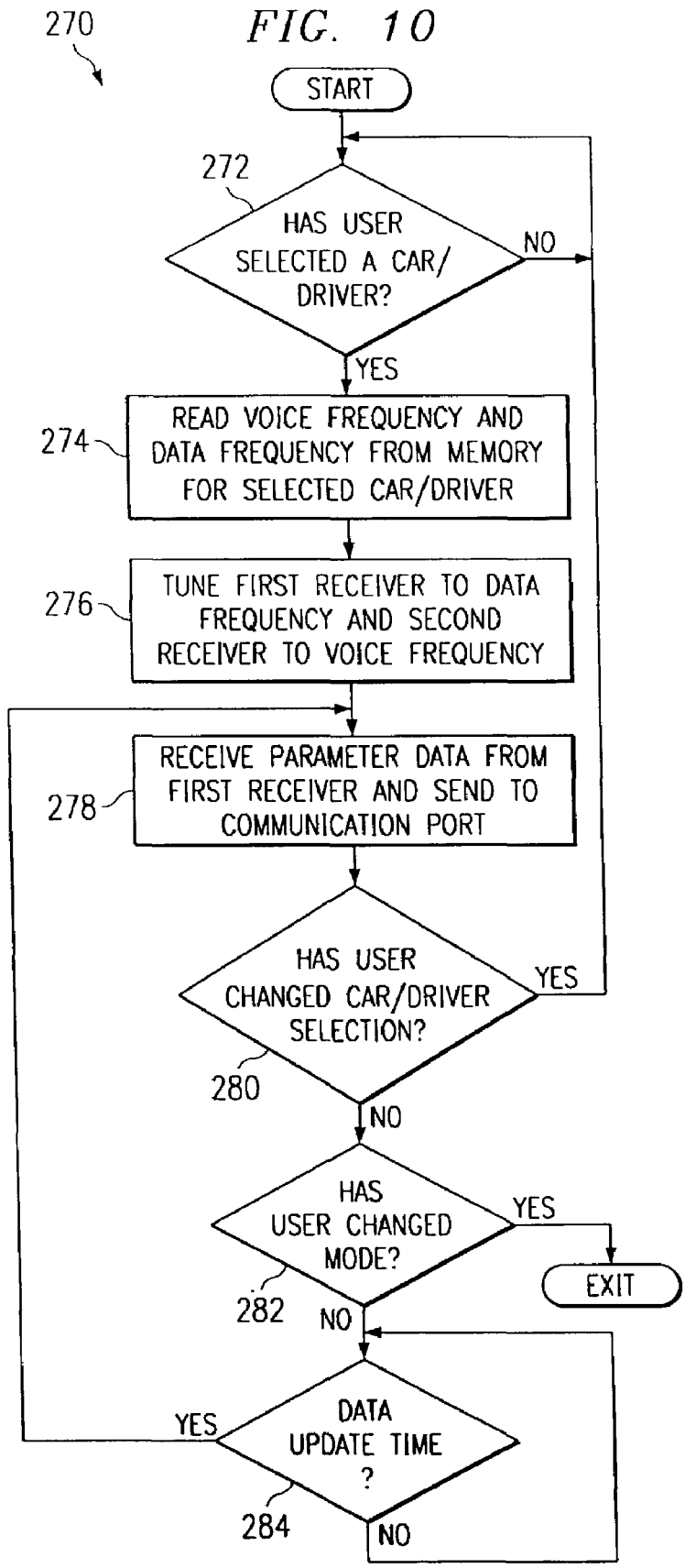
270
FIG. 10
START
272
HAS USER SELECTED A CAR/ DRIVER?
NO
YES
274
READ VOICE FREQUENCY AND DATA FREQUENCY FROM MEMORY FOR SELECTED CAR/DRIVER
276
TUNE FIRST RECEIVER TO DATA FREQUENCY AND SECOND RECEIVER TO VOICE FREQUENCY
278
RECEIVE PARAMETER DATA FROM FIRST RECEIVER AND SEND TO COMMUNICATION PORT
HAS USER CHANGED CAR/DRIVER SELECTION?
YES
280
NO
HAS USER CHANGED MODE?
YES
EXIT
282
NO
DATA UPDATE TIME ?
YES
284
NO

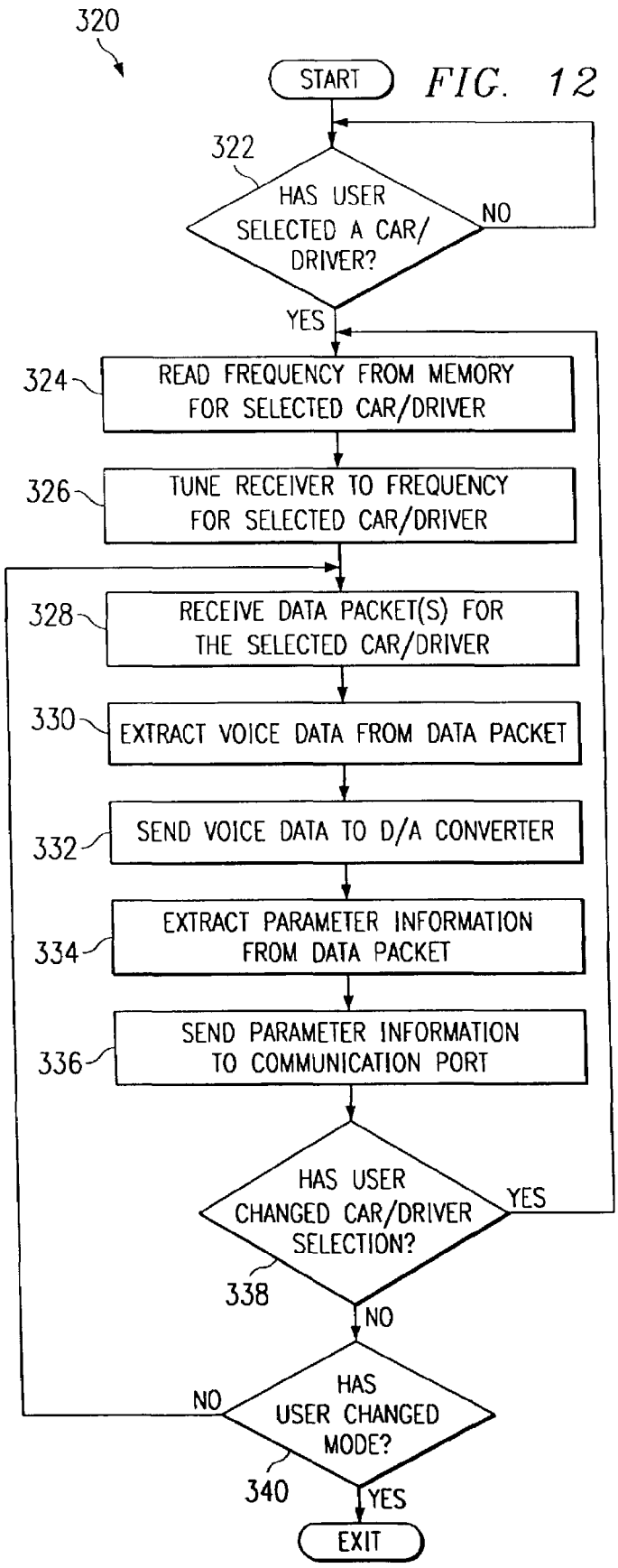
320
START
FIG. 12
322
HAS USER SELECTED A CAR/ DRIVER?
NO
YES
324
READ FREQUENCY FROM MEMORY FOR SELECTED CAR/DRIVER
326
TUNE RECEIVER TO FREQUENCY FOR SELECTED CAR/DRIVER
328
RECEIVE DATA PACKET(S) FOR THE SELECTED CAR/DRIVER
330
EXTRACT VOICE DATA FROM DATA PACKET
332
SEND VOICE DATA TO D/A CONVERTER
334
EXTRACT PARAMETER INFORMATION FROM DATA PACKET
336
SEND PARAMETER INFORMATION TO COMMUNICATION PORT
HAS USER CHANGED CAR/DRIVER SELECTION?
YES
338
NO
HAS USER CHANGED MODE?
NO
340
YES
EXIT

RADIO RECEIVER APPARATUS FOR CONCURRENT RECEPTION OF VOICE AND RELATED INFORMATION

TECHNICAL FIELD OF THE INVENTION

The present invention pertains in general to radio receivers and in particular to such receivers which can automatically tune to preprogrammed frequencies.

BACKGROUND OF THE INVENTION

Automobile racing is a popular spectator sport and persons attending such racing events often desire to be closer to participants in the racing event, rather than merely observers of the race. The spectators who attend racing events, such as NASCAR, often identify with particular drivers and wish to know as much as possible about what is happening with regard to their favorite driver during the race. Race cars are frequently equipped with two-way radios so that the drivers can communicate with their pit crews and managers so that the driver can be informed of what is happening on the race track and the driver can inform the members of the pit crew concerning the race and condition of the car. Spectators can monitor these communications and gain a more intimate contact with the race and thus enhance the enjoyment of the racing event. Such spectator interest also applies to other types of events such as golf, baseball, basketball, etc.

Portable handheld scanning radios have been available which can be utilized for monitoring these communications. An example of such a radio designed for sporting events is the Uniden Model SC200. The systems described herein are radio receivers with capabilities that further enhance the spectators' experience at a sporting event or other venues which have both audio, such as voice, and data.

SUMMARY OF THE INVENTION

A selected embodiment of the invention is a radio receiving apparatus having a first radio receiver for receiving audio signals and a second radio receiver for receiving data signals. A memory stores a first radio frequency and a second radio frequency wherein the first radio frequency and the second radio frequency relate to a common entity. A digital tuner control is connected to the memory for tuning the first radio receiver to the first frequency while producing a first receiver output signal. The control tunes the second radio receiver to the second radio frequency for producing a second receiver output signal. The first radio receiver and the second radio receiver operate concurrently. An audio transducer is coupled to the first receiver output signal for producing audible signals therefrom. A graphics display is coupled to receive the second receiver output signal for producing a graphic image therefrom. The audible sounds and the graphic image relate to the common entity.

In a further embodiment of the present invention, a radio receiving apparatus has a tunable receiver and a memory that stores a plurality of radio frequency signals corresponding to each of a plurality of entities. A digital tuner control is connected to the memory for tuning the radio receiver to the frequency corresponding to a selected one of the entities. The receiver receives a composite signal which comprises an audible signal associated with the selected entity and digital data also associated with the selected entity. Within the receiving apparatus, the audio signal is separated from the data signal. The audio signal is provided to an output terminal for producing an audible sound. The digital data is provided to a graphics display for producing a graphic image where the audible sound and the graphic image relate to the selected entity.

In a further aspect of the present invention, a portable receiving apparatus having a tunable receiver is connected to a separate portable display unit and the combined units receive related audio and data information for producing an audible sound and a related graphic image.

The present invention can utilize voice, video and data information together or various combinations thereof.

BRIEF DESCRIPTION OF THE DRAWINGS

For a more complete understanding of the present invention, reference is now made to the following Detailed Description taken in conjunction with the drawings in which:

FIG. 7 is a flow diagram illustrating operation of the voice and data radio receiver shown in FIG. 6;

FIG. 8 is an illustration of a voice and data radio receiver apparatus module connected to a personal digital assistant (PDA) which generates a graphics display;

FIG. 9 is a block diagram of a further embodiment of a voice and data radio receiver used in conjunction with a PDA;

FIG. 10 is a flow diagram illustrating operation of the voice and data radio receiver shown in FIG. 9;

FIG. 12 is a flow diagram illustrating operation of the voice and data radio receiver shown in FIG. 11;

DETAILED DESCRIPTION

Systems described herein are directed to radio receivers used in conjunction with automobile racing. However, the technology is also applicable to any spectator event where fans would like to enhance the live event with real-time statistics/information (data) of what is happening at an event.

Figure 1:
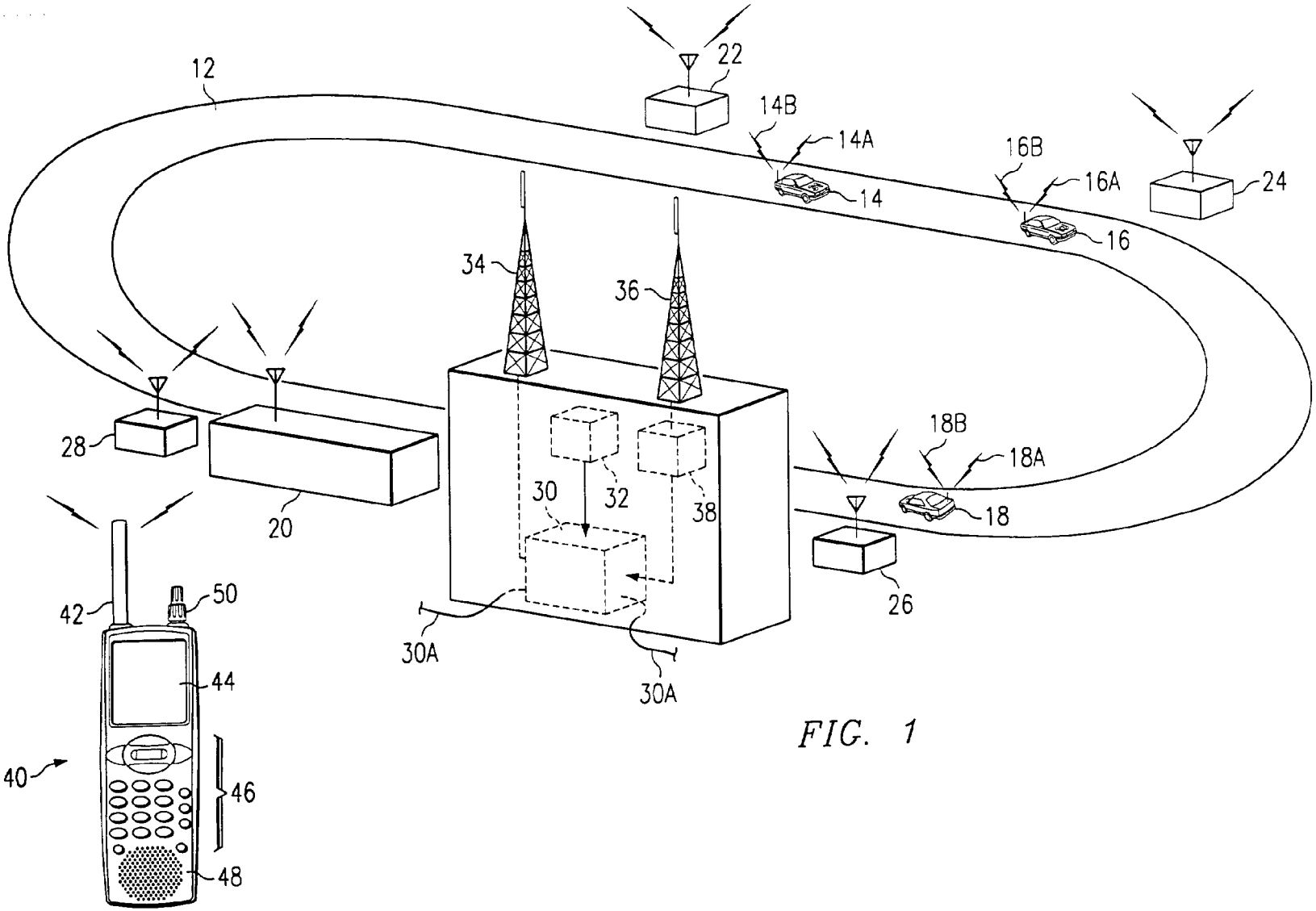
FIG. 1 is an illustration of a race track with multiple radio transmitters and receivers for voice and data.

Referring to FIG. 1, there is shown in schematic form a racing facility having a track 12 with race cars 14, 16 and 18. Each of the race cars is equipped with two radio communication systems. The first is a conventional two-way voice communication system which provides transmissions represented as 14A, 16A and 18A. These transmissions are made between a driver and a pit station 20, thereby establishing voice communication between the driver and the crew of a car.

Each of the cars 14, 16 and 18 is also equipped with a telemetry radio which transmits information regarding the race car. This is indicated as transmissions 14B, 16B and 18B. The telemetry transmissions are conveyed through wireless transmissions, and these signals are received at a plurality of receiving stations 22, 24, 26 and 28 distributed around track 12. The telemetry transmissions are typically low power with short range and therefore are best received by a group of distributed receiving stations located near the track as shown. The stations 22, 24, 26 and 28 are connected to a processing system 30 at a central location by a communication line 30A that is connected to each of the stations. The telemetry system in a car sends data representing car parameters such as speed, engine RPM, braking, and other parameters that could be of importance to the racing team or of interest to the spectators.

A local data entry system 32 collects information related to a car and driver in the race such as track position (first place, second place, etc.), lap, time behind leader, lap time, pit time (after a driver has made a pit stop), driver name and car number. The system 32 can also collect raw data which is analyzed and formatted by the computer of system 32. The data entry station 32 can be a data entry terminal to a computer or a stand-alone personal computer. This information is transferred to the processing system 30 which then transmits the information through an antenna 34 with sufficient power to provide the transmissions to receivers located within the region of the track 12.

In an alternate aspect, the two-way voice communications between the drivers and crews can be received concurrently through an antenna 36 and receiving system 38 which provides the voice signals to the processing system 30. In this alternate aspect, the system 30 combines the voice signals for each car/driver and the corresponding parameter data and the combined signal for each car/driver is transmitted through antenna 34 to each of the voice/data receivers in the vicinity of track 12.

A voice and data radio receiver 40, as further described herein, is used within the vicinity of the track 12 such that it can receive data transmissions from the antenna 34, as well as the direct voice transmissions from the cars 14, 16 and 18. The receiver 40 includes an antenna 42, a display screen 44, a set of keys 46 and a speaker 48. This embodiment is described in more detail in FIGS. 2 and 4.

Figure 6:
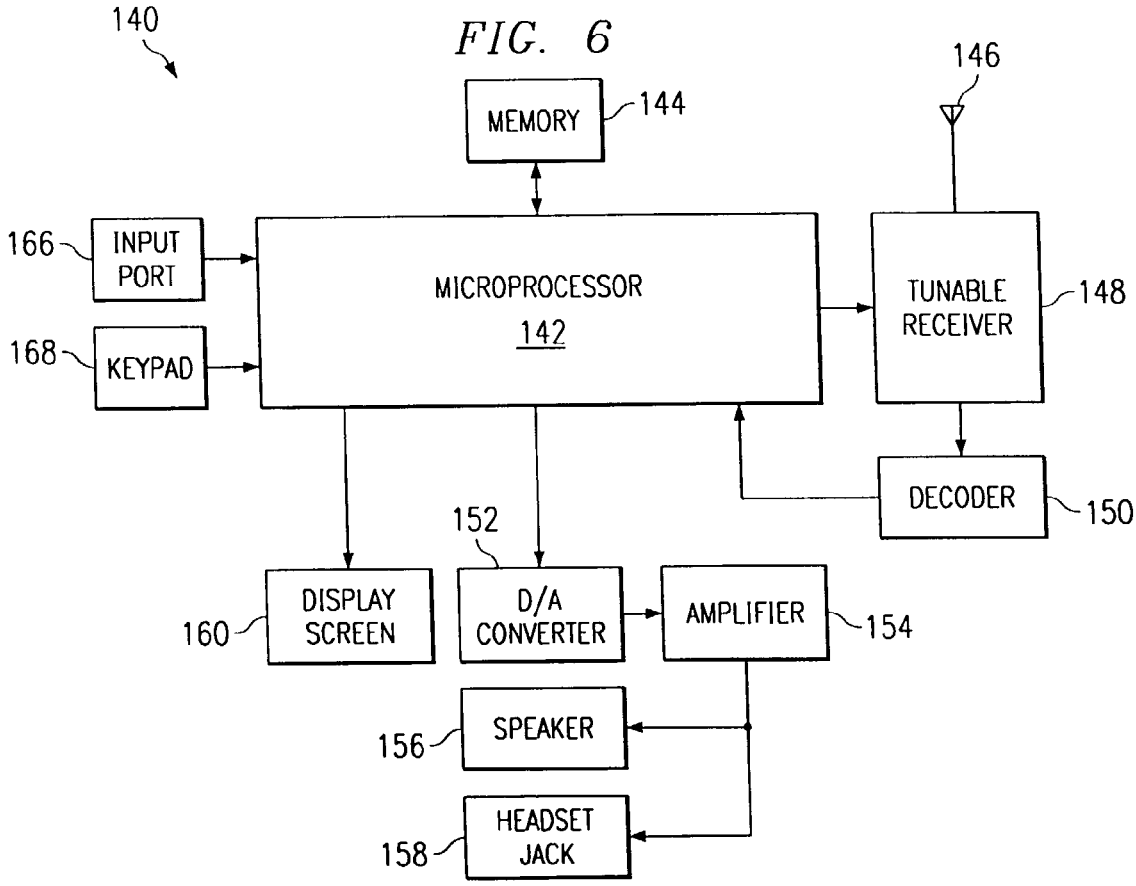
FIG. 6 is a block diagram of a further embodiment of an integrated voice and data radio receiver.

A further voice and data radio receiver embodiment is described in reference to FIGS. 6 and 7, wherein the receiver receives the combined voice and data signal. The processing system 30 receives the data from antenna 34 and system 32 and the voice signals from receiving system 38. System 30 combines the data and voice into a single signal that is transmitted through antenna 34.

Figure 2:
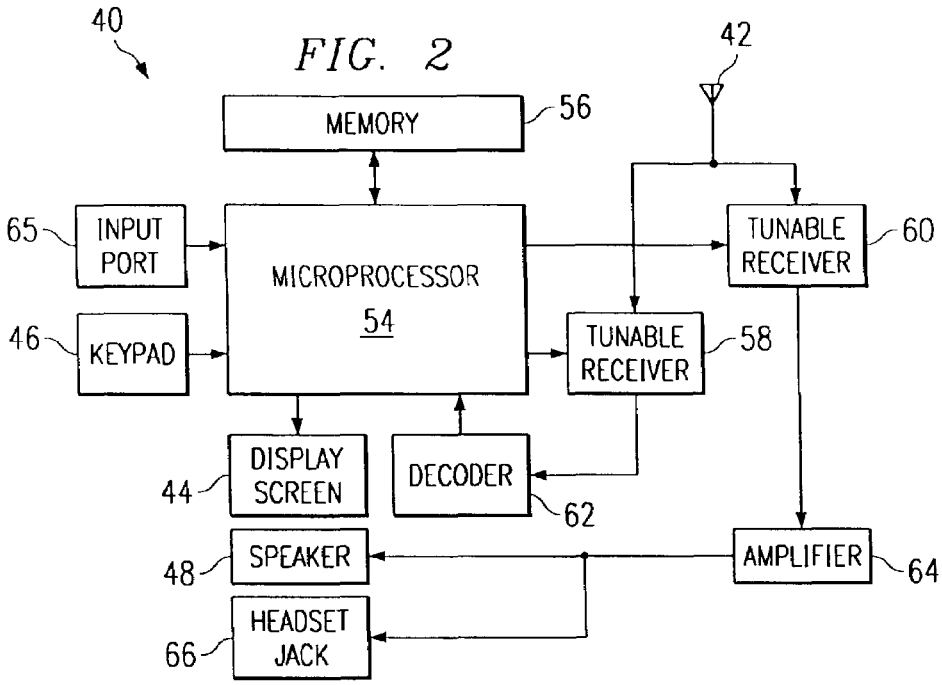
FIG. 2 is a block diagram of a first embodiment of a voice and data radio receiver.

Referring to FIG. 2, there is shown a block diagram of receiver 40, as shown in FIG. 1. The receiver 40 is controlled by a microprocessor 54 which is operated in conjunction with a memory 56 that includes program code and data. The antenna 42 is connected to provide radio frequency signals to a first tunable receiver 58 and to a second tunable receiver 60. The receivers 58 and 60 operate concurrently and are frequency tuned by the microprocessor 54. The output from the receiver 58 is provided to a decoder 62 which provides a digital signal to the microprocessor 54. The output (audio signal) of receiver 60 is provided to an amplifier 64 which drives the speaker (audio transducer) 48 and/or a headset jack 66. A user can connect a headset to jack 66 for listening to the driver/crew conversations.

The receiver 40 further includes an input port 65 which is connected to the microprocessor 54 for receiving data which is then stored in the memory 56. The port 65 can be, for example, an infrared receiver, or an electrical connector. The keypad 46 provides entry of control commands and information for operation of the receiver 40.

Figure 3:
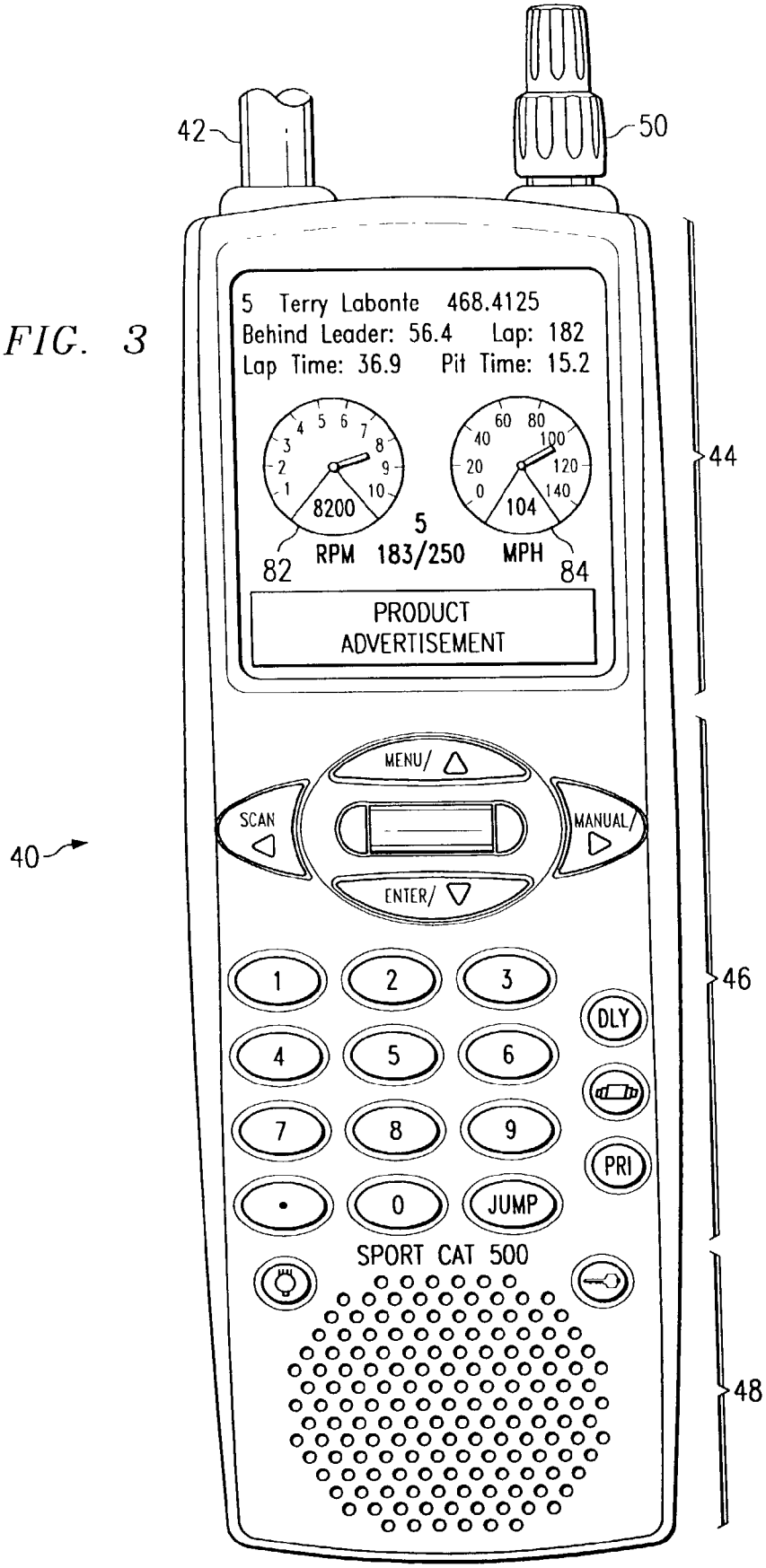
FIG. 3 is an illustration of an integrated voice and data radio receiver, such as shown in FIGS. 1 and 2.

Referring to FIG. 3, there is shown the receiver 40 with specific information as could be seen during use at a race. The display screen 44 includes on the first line thereof a car number (5), driver (Terry Labonte), and voice frequency (468.4125 MHz). The second line has the number of seconds (56.4) that this driver is behind the leader of the race and the lap (182) of this driver. The third line has the time (36.9 sec) which was taken by this car to complete the last full lap and the amount of time (15.2 sec) spent by this car in its last pit stop. Below the text, there are two circular displays with the engine RPM being shown on the left with a digital representation and an analog type gauge. Speed in miles per hour is shown on the right, again with a digital representation in the lower center and an analog type gauge indicating speed. Between the gauges there is shown the position of this car/driver in the race. As shown, this driver is in 5th place. Below the race position there is shown the laps completed by the race leader and total laps of the race (183/250). Below the two circular gauges, there is an area reserved for product advertisements. The numerical information about a car/driver is referred to as parameter data". The present invention is not limited to the specific information displayed in FIG. 3 or to the specific sport of automobile racing.

The display on the screen 44 can be text and/or graphics. The display shown in FIG. 3 on screen 44 has both text and graphics.

Further referring to FIG. 1, the drivers, cars, voice channels and data channels for the three illustrated race cars in FIG. 1 are shown in Table 1.

TABLE 1

| DRIVER | CAR | VOICE CHANNEL | TELEMETRY CHANNEL |
|---|---|---|---|
| A | 14 | 452.0500 | 254.0020 |
| B | 16 | 468.2125 | 254.0180 |
| C | 18 | 460.9500 | 254.0060 |

Note that for each car and driver combination, there is a specific frequency for a voice channel which can be received by the receiver 40 and a corresponding frequency for a data channel which is concurrently received by the receiver 40. All frequencies shown in this and other tables are in megahertz.

Alternatively, the telemetry information for a plurality of cars may be transmitted on one frequency channel.

Before the receiver 40 is used at an event, such as a race, the voice and data channel frequencies must be entered into the receiver. This can be done manually by the user by selecting a data entry mode and keying into the receiver 40 the required information, such as shown in Table 2. Alternatively, this information can be loaded electronically into the receiver 40 through the port 65, which can be an infrared receiver, or through a connecting port, such as an RS-232, Ethernet or USB line to a computer. Other methods for loading this information include wireless technology such as Bluetooth and the standard 802.11, magnetic, optical and bar code.

TABLE 2

| CAR | DRIVER | VOICE | DATA |
|---|---|---|---|
| 1 | Kenny Wallace | 464.9250 | 254.0440 |
| 2 | Rusty Wallace | 451.8250 | 255.0240 |
| 4 | Mike Skinner | 461.7500 | 254.1240 |
| 5 | Terry Labonte | 468.2125 | 254.0180 |
| 6 | Mark Martin | 460.9500 | 254.0060 |
| 7 | Casey Atwood | 457.3750 | 255.0010 |
| 8 | Dale Earnhardt Jr. | 452.0500 | 254.0020 |
| 9 | Bill Elliott | 462.7625 | 254.0050 |
| 10 | Johnny Benson | 457.1750 | 254.1280 |
| 11 | Brett Bodine | 461.7875 | 254.2020 |
| 12 | Ryan Newman | 464.8000 | 255.0120 |
| 14 | Stacy Compton | 460.4875 | 254.1420 |
| 15 | Michael Waltrip | 464.9500 | 254.1480 |
| 17 | Matt Kenseth | 462.2000 | 254.0800 |
| 18 | Bobby Labonte | 451.3000 | 255.0710 |
| 19 | Jeremy Mayfield | 452.4500 | 254.0780 |
| 20 | Tony Stewart | 451.4000 | 254.1080 |

Figure 4:
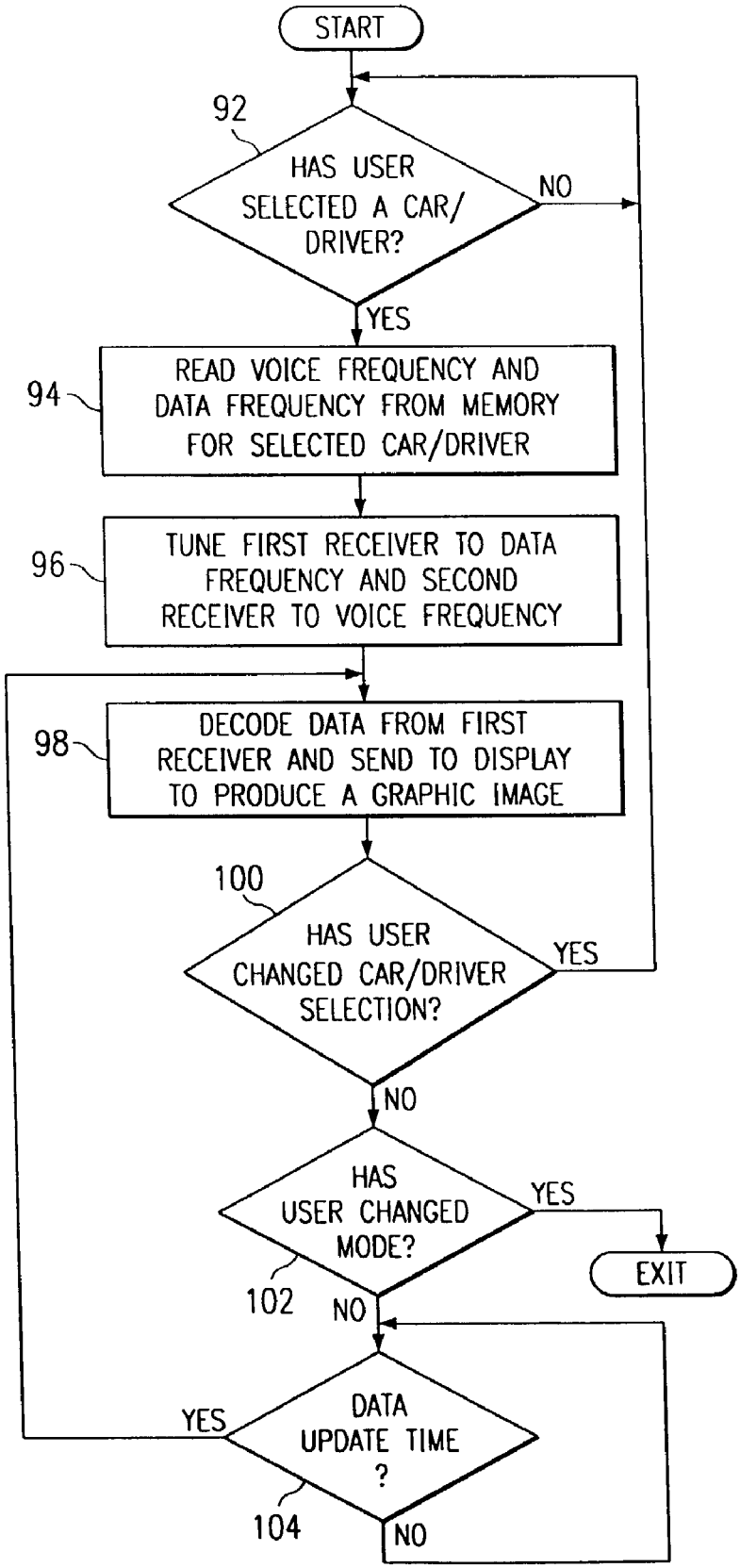
FIG. 4 is a flow diagram illustrating operation of the voice and data radio receiver shown in FIG. 2.

Referring to FIG. 4, there is shown a flow diagram for the operation of the receiver 40 for a mode of operation to produce concurrent related voice and parameter data pertaining to a selected car/driver for a user. The receiver 40 can have other modes of operation, such as a conventional scanning radio or simply tuning to a selected, manually entered, frequency. Reception can include AM or FM radio, television or from satellite. Following the start, a question block 92 is entered to determine if a user has selected a car/driver. If not, return is made to the entry of the block until a car/driver is selected. Once a car/driver has been selected, entry is made to block 94 wherein the microprocessor 54 reads a pair of frequencies from the memory 56. These are the voice frequency and the data frequency for the selected car/driver.

Following block 94, entry is made to block 96 wherein the microprocessor functions as a digital tuner and tunes the first tunable receiver 58 to the data frequency and the second tunable receiver 60 to the voice frequency corresponding to the selected car/driver. Entry is next made to block 98 wherein the output from the first tunable receiver is received as digital data and the microprocessor 54 generates data for producing a graphic image at the display 44. Such a graphic image is shown in FIG. 3 with parameter data (information) about a selected car, driver and related information.

Following block 98, entry is made to question block 100 to determine if the user has changed his selection of car/driver. If so, entry is made back to question block 92 to repeat the process thus described. If no change has been made in block 100, entry is made to question block 102 to determine if the user has changed the mode of operation of the receiver 40 to one other than monitoring voice and data for a car/driver as described above. If so, the program makes an exit for this mode. If no change in mode has been made, entry is made to a data time question block 104 to determine if a predetermined time has elapsed such that the parameter data should be updated. If so, entry is made back to block 98 to decode data currently received from the first (data) receiver 58 and produce a new graphic image on the display 44. Thus, by repeating the update of the graphic image on a frequent basis, the user is provided with an updated display of parameters related to the selected car and driver, such as speed and engine RPM while concurrently receiving the driver/crew radio conversation.

Figure 5:
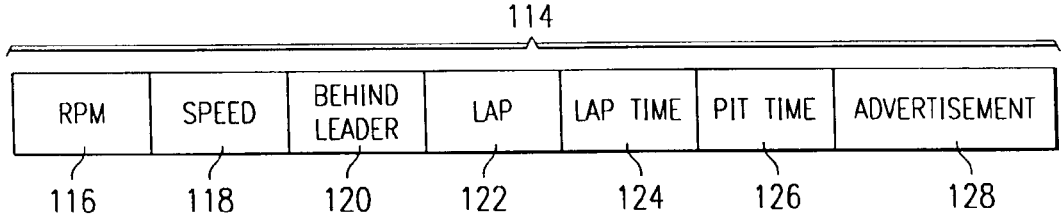
FIG. 5 is an illustration of a parameter data stream transmitted through a data channel.

A data frame 114 as may be used by the receiver 40 is illustrated in FIG. 5. This sequential frame of data is transmitted repeatedly by the processing system 30 through the antenna 34 for each car/driver. This data frame includes RPM (revolutions per minute) 116, speed (miles per hour) 118, seconds 120 of the selected car/driver behind the leader, lap 122, lap time 124 in seconds, pit time 126 in seconds and an advertisement 128. The parameter data in this frame are frequently updated so that the user of the receiver 40 has current information displayed about the selected car/driver.

A further embodiment is a voice and data receiver 140 which is shown as a block diagram in FIG. 6. This embodiment can be implemented as shown for the receiver 40 in FIGS. 1 and 3 and the outputs/displays produced for the user are the same as described for the receiver 40. The receiver 140 includes a microprocessor 142 which works in conjunction with a memory 144 which stores program code and data. The receiver 140 has an antenna 146 that receives a signal which is provided to a tunable receiver 148. The tunable receiver 148 is tuned to a selected frequency by operation of the microprocessor 142 which functions as a digital tuner. When tuned to a selected frequency, the output from the tunable receiver 148 is provided to a decoder 150 that produces a digital signal which is provided to the microprocessor 142. The signal received by the receiver 148 is a composite signal which includes both the voice conversation (in data form) between a driver and his crew as well as the parameter data from the car and information about the car, such as shown in the display in FIG. 3. Referring to FIG. 1, the voice signals are collected by the receiving antenna 36 which provides them to the system 38 which in turn provides the voice signals for each driver to the processing system 30. The parameter data, as previously described, for each car is combined with the voice signal for that car in digitized form, such as packets, that are transmitted via the antenna 34 and received by the receiver 140. One selected transmission format can be defined by the standard 802.11b for wireless transmission of data. Data transmission in accordance with this standard is well known in the art. In one implementation, analog voice can be digitized and transmitted as voice packets and the parameter data can be transmitted as data packets. Each packet can have a header block that identifies the type of packet (voice or data) and the car/driver associated with the packet. Within the microprocessor 142, referring to FIG. 6, the voice digital data, such as in voice packets, is separated from the parameter data, such as in data packets, and the voice digital data is provided to a digital to analog (D/A) converter 152 which produces a voice signal in analog form and provides this signal to an amplifier 154. The amplified voice signal is then provided to a speaker 156 and to a headset jack 158. These correspond respectively to the speaker 48 and headset jack 66 shown in FIG. 2.

Further referring to FIG. 6, the microprocessor 142 decodes the parameter data, as described above, and produces a graphic image, also as described above, at a display 160, which corresponds to the display 44 of receiver 40.

The receiver 140 further includes an input port 166 and a keypad 168 which corresponds to the input port 65 and keypad 46 shown in FIG. 2. The frequency data for each car/driver can be entered through the port 166.

The receiver 140 utilizes a single tunable receiver 148 because the information that is transmitted, both voice and parameter data, is combined in a single signal which is made possible through packetizing the voice using the internet protocol (IP) format and then transmitted wirelessly through various wireless technologies, such as 802.11b. Transmission can be done through home RF, digital spread spectrum or other wireless protocols. The user receives continuous voice and a concurrent updated data display as previously described.

A flow diagram 180 illustrating the operation of the receiver 140 is shown in FIG. 7. After start, a question block 182 is entered to determine if a user has selected a car/driver. If not, re-entry is made to this block. If yes, a frequency is read from the memory for the selected car/driver in block 184. In the embodiment herein where only one frequency is utilized for the combined voice and parameter data information, the initial set up is shown in FIG. 2, but without the column for the voice frequencies. This data can be entered automatically through port 166 or keyed in through keypad 168. The data transmission can be at a higher frequency such as in the gigahertz region, for example, in unlicensed bands.

In block 186, the receiver 148 is tuned to the frequency read from the memory 144 by operation of the microprocessor 142. This enables receiving the data related to the selected car and driver, both voice and telemetry information. This information is preferably received in data packets.

Continuing to block 188, the combined data is received as packets for the selected car and driver. This data is converted to digital information that is provided to the microprocessor 142.

In block 190, the voice data is extracted from the overall data packet. In block 192, this voice data is sent to the digital to analog converter 152 which produces an analog voice signal that is amplified by the amplifier 154 and then provided to the speaker 156 and/or the headset jack 158 which can be used to drive a user headset.

In block 194, the microprocessor 142 extracts the parameter data for the selected car and driver from the data packets that have been received. In block 196, the parameter data is sent to the display 160 for producing a graphic image, such as that shown in FIG. 3 for display 44.

Continuing to a question block 198, an inquiry is made to determine if the user has changed his selection of car/driver. If the answer is yes, entry is made to block 184 to read the frequency from memory for the newly selected car/driver. The process is repeated as described above for receiving the voice and telemetry data related to the selected car and driver.

If the response is no at question block 198, entry is made to question block 200 to determine if the user has changed the mode of operation for the receiver 140. If not, entry is made to block 188 to update and continue to receive the data packets for the selected car and driver. If the response at block 200 is yes, the current mode of operation is terminated with an exit from this operation.

A further configuration of a voice/data receiver is illustrated in FIG. 8. A voice and data receiver module 210 is used in conjunction with a conventional personal digital assistant (PDA) 212 which may be, for example, a Palm Pilot or similar type of product. The receiver module 210 includes an antenna 214, a multiple conducting line connector 216, a headset jack 218 and a control switch 220.

The PDA 212 includes a display screen 226, a set of control switches comprising a keypad 228 and a port 230 for receiving the connector 216. The PDA 212 also has an infrared port 232 for bidirectional data communication.

Although a PDA is shown in this embodiment, any portable programmable electronic device with a display and an input port can be used. An example of such a product is a Game Boy® handheld video game player manufacture by Nintendo. Further display devices can be cell phones, cordless phones and graphic pagers.

The module 210 is adapted to have a mechanical snap fit with the PDA 212 such that, when connected, the PDA 212 and the module 210 comprise an integral unit. The voice and data produced by the integral unit are substantially the same as that shown for the receiver 40 illustrated in FIG. 3.

A functional embodiment for the receiver module 210 is shown as a receiver 240 in FIG. 9. The receiver 240 is used in conjunction with the PDA 212 as illustrated in FIG. 8.

The receiver 240 includes a microprocessor 242 which operates in conjunction with a memory 244 which stores program code and data. The antenna 214 is connected to a first tunable receiver 246 and to a second tunable receiver 248. The receivers 246 and 248 operate concurrently. The tuning of the receivers 246 and 248 is performed by the microprocessor 242. The output from the receiver 246 is provided to a decoder 250 that produces a digital output which is provided to the microprocessor 242. The output from the receiver 248 is provided to an amplifier 252 which provides the output thereof to a headset jack 254. The user can connect a headset 256 to the headset jack 254 for receiving audible sounds. Receiver 246 handles the parameter data and receiver 248 handles analog voice data.

The microprocessor 242 receives digital parameter data from the decoder 250 and this data is provided to a communication port 262 which is electrically connected to the connector 216. The connector 216 is engagable to the port 230 of the PDA 212.

The receiver 240 functions in much the same way as the receiver 40 shown in FIG. 2 wherein the receivers 240 and 40 receive voice signals directly from the cars, such as 14, 16 and 18 and receive a separate parameter data signal, such as that transmitted from antenna 34 by the processing system 30. The parameter data, as described above, is received by the tunable receiver 246 and converted by decoder 250 into digital form that is received by the microprocessor 242. This digital information is transmitted through the communication port 262 and connector 216 to the PDA 212 for producing an image such as that shown on screen 44 in FIG. 3.

The antenna 214 receives the voice communications between the car drivers and their crews and this is received for a particular driver by tunable receiver 248. The received signal is amplified by amplifier 252 and the resulting signal is passed through headset jack 254 to a user headset 256.

Car/driver frequency information, as shown in Table 2, can be electronically conveyed through the PDA infrared port 232 (or through port 230) via communication port 262 and microprocessor 242 to memory 244.

Operation of the receiver 240 shown in FIG. 9 is illustrated by flow diagram 270 shown in FIG. 10. After the start, entry is made to question block 272 which determines if the user has selected a particular car/driver. If the response is no, entry is made back to the start of this block for awaiting such a selection. If the response is yes, entry is made to a block 274 wherein the microprocessor 242 reads both a voice frequency and a data frequency from the memory 244 for the selected car/driver. This information has been previously entered in the form shown in Table 2 above.

Following block 274, entry is made to block 276 wherein the microprocessor 242 functions as a digital tuner to tune the first receiver 246 to the data frequency and the second receiver 248 to the voice frequency for the selected car/driver.

Continuing to block 278, the microprocessor 242 receives parameter data from the receiver 246 via the decoder 250 and sends this data to the communication port 262 wherein it is communicated through the connector 216 to the PDA 212. This parameter data is utilized to generate a display, such as that shown in display 44 in FIG. 3. This display is produced on the display 226 of the PDA 212.

Following block 278, entry is made to question block 280 to determine if the user has changed selection of car/driver. If the response is yes, entry is made back to block 272 for re-entry into the process for selecting frequencies and producing data as described above. If the response in question block 280 is no, entry is made to question block 282 to determine if the user has changed the mode of operation for the receiver 240. If the answer is yes, transfer is made to exit this sequence of operations. If the response is no, entry is made to a question block 284 to determine if a data update time has been reached. If not, entry is made back to the start of this question block. If the time has been reached, the yes exit is taken and entry is made back to block 278 for receiving new parameter data and updating the display on the screen 226 of the PDA 212.

Figure 11:
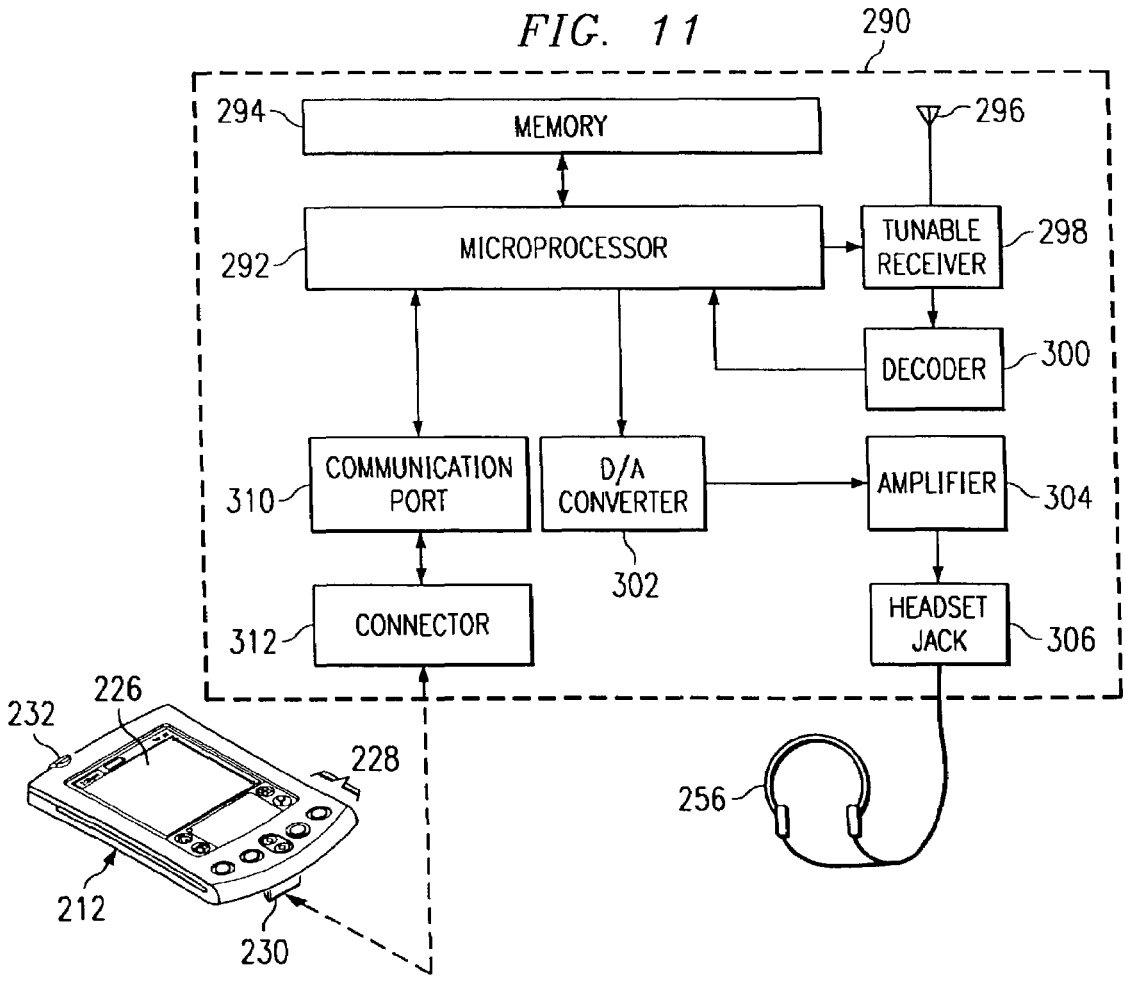
FIG. 11 is a block diagram of a further embodiment of a voice and data radio receiver used in conjunction with a PDA.

A block diagram for a receiver 290 which can also be utilized for the PDA module 210 shown in FIG. 8 is illustrated in FIG. 11. The receiver 290 includes a microprocessor 292 which works in conjunction with a memory 294 that stores program code and data. An antenna 296 receives signals that are provided to a tunable receiver 298. The output of receiver 298 is provided to a decoder 300 which provides the received signal in digital form to the microprocessor 292. The signal provided to receiver 290 is digital data which includes both voice and parameter data.

Within the microprocessor 292, the voice component of the received signal is separated from the parameter data. The voice data is provided by the microprocessor 292 to a digital to analog (D/A) converter 302 which produces an analog signal at the output thereof. This analog signal is conveyed to an amplifier 304 which in turn provides an output signal to a headset jack 306. The user headset 256 can be driven by the signal from the headset jack 306.

The parameter data extracted from the received signal by the microprocessor 292 is conveyed to a communication port 310 which is electrically coupled to a connector 312. The connector 312, which corresponds to the connector 216 shown in FIG. 8, engages the port 230 of the PDA 212 for bi-directional communication.

The operation of the receiver 290 is described in a flow diagram 320 shown in FIG. 12. Following the start, entry is made to a question block 322 to determine if the user has selected a car/driver. If not, re-entry is made to this block. If the response is yes, entry is made to a block 324 wherein the microprocessor 292 reads a frequency from the memory 294 that corresponds to the selected car/driver. The data which is previously stored in the memory 294 for an event, such as a race, corresponds to that shown in Table 2, but without the voice frequencies, since both the parameter data and the voice signal are combined into one signal.

In block 326, the microprocessor 272 operates the tunable receiver 298 to tune it to the frequency for the selected car/driver. Continuing to block 328, the receiver 290 receives data packets, one or multiple, through the antenna 296, receiver 298, decoder 300 to the microprocessor 292. Thus, the microprocessor 292 receives therein digital data representing both the voice signal and the parameter data.

In block 330, the voice data is separated from the other data in the data packet. Next, in block 332, the voice data is sent to the digital to analog converter 302. The converter 302 produces the analog version of a voice signal which is passed through amplifier 304 and headset jack to headset 256.

After block 332, entry is made to block 334 wherein the parameter data information is extracted from the data packet. In block 336, this parameter information is transmitted through the communication port 310 and connector 312 to the PDA 212. Within the PDA 212, a display, such as that shown for display 44 in FIG. 3, is produced on the display 226 of the PDA 212.

Continuing to question block 338, an inquiry is made to determine if the user has changed the car/driver selection. If so, entry is made back to block 324 to select a new frequency for tuning the receiver 298. The sequential process as described above is repeated. If the user has not changed the car/driver selection in block 338, entry is made to question block 340 which determines if the user has changed the mode of operation of the receiver 290 to other than that of monitoring a particular car/driver. If the answer is yes, exit is made from this operational sequence. If the answer is no, control is transferred back to block 328 to receive the next data packets for processing as described in the sequential steps.

Figure 13:
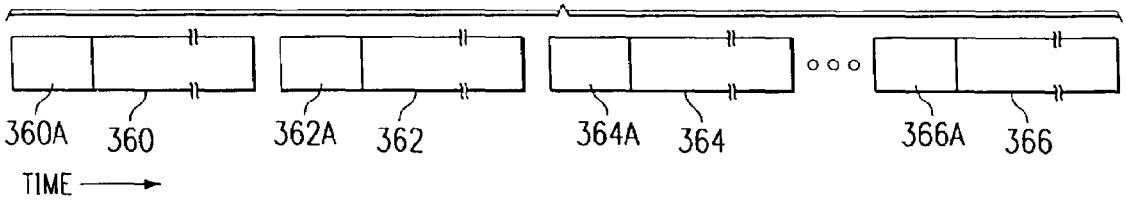
FIG. 13 is an illustration of voice and data packets which are transmitted as digital information for use by receiving apparatus described herein.

As noted above, the voice and parameter information relating to a particular race car can be transmitted as digital packets. An illustration of such packets is shown in FIG. 13. Packets 360, 362 and 364 are transmitted in timed sequence and each packet has a corresponding header 360A, 362A and 364A. The header of the packet defines the type of information (voice or data) and identifies the particular car/driver related to the information. For example, packets 360 and 362 may be voice information while packet 364 is parameter data. There may unequal numbers of the two types of packets with voice packets being transmitted more frequently than data packets so that the voice signal produced is not interrupted. The data packets can be transmitted within the voice packet so as to not interrupt the voice transmissions.

Figure 14:
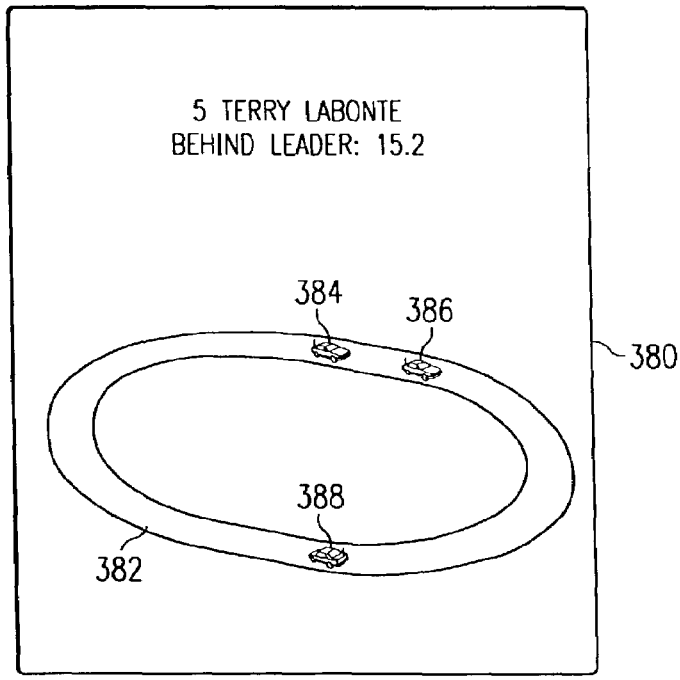
FIG. 14 is an alternative display for illustrating relative positions of race cars on a track.

An alternative graphic (with text) display screen 380 for use on a display is shown in FIG. 14. This text and graphic display can be used with any one of the previous devices having a display screen described herein. The display 380 includes a text identification of a car number, a driver and the position in time of that driver behind the leader. In this example, it is shown that the selected driver is 5.2 seconds behind the race leader. This display further includes a graphic illustration of a race track 382 and on the track there are shown symbols representing the race cars. These are symbols 384, 386 and 388. Any number of symbols may be used, but in this particular example, there is shown the first place car, second place car and the car selected to be of particular interest for the user of the receiving apparatus. The symbols can be differentiated by color, texture, shape or by on/off flashing of the particular symbol so that it is apparent to the user which car is the selected car, such as car 5 shown in FIG. 14, and which of the two cars represent the first and second place cars in the race. For example, as shown in FIG. 14, the first place car can be represented by symbol 384 (a first color), the second place car by symbol 386 (a second color) and the car selected to be of interest by this user is represented by symbol 388 (a third color). This gives the user the relative positions of the cars of most interest to that particular user in the race.

The information for defining the shape of the track 382 can be entered and stored in the memory of the receiving apparatus. The information defining the particular location of the car on the race track can be provided by any one many techniques that are updated frequently. The cars can be located by position locating apparatus using radio triangulation, electronic sensors positioned around the track with corresponding car identification transmitters, GPS equipment located in the automobiles, or optical identification of the vehicle identity and location from real time television images. Thus, the display 380 shown in FIG. 14 can provide still further information to a user of the radio receiving apparatus concerning the status of the race.

Although multiple embodiments of the invention have been illustrated in the accompanying drawings and described in the foregoing Detailed Description, it must be understood that the invention is not limited to the embodiments disclosed but is capable of numerous rearrangements, modifications and substitutions without departing from the scope of the invention.

What is claimed is:

1. A radio receiving apparatus comprising:

a first radio receiver for receiving audio signals, a second radio receiver for receiving data signals, a memory for storing therein a first radio frequency and a second radio frequency wherein said first radio frequency and said second radio frequency relate to a common entity, a digital tuner control connected to said memory for tuning said first radio receiver to said first frequency for producing a first receiver output signal and for tuning said second radio receiver to said second radio frequency for producing a second receiver output signal, wherein said first radio receiver and said second radio receiver operate concurrently, an audio transducer coupled to receive said first receiver output signal for producing an audible sound therefrom, and a display screen coupled to receive data from said second receiver output signal for producing a display thereon, wherein said audible sound and said display relate to said common entity.

2. A radio receiving apparatus as recited in claim 1 including an input port for receiving said radio frequencies for storage in said memory.

3. A radio receiving apparatus as recited in claim 1 including an infrared input port for receiving said radio frequencies for storage in said memory.

4. A radio receiving apparatus as recited in claim 1 including a keypad for providing said radio frequencies for storage in said memory.

5. A radio receiving apparatus as recited in claim 1 wherein said display includes both text and graphics.

6. A radio receiving apparatus as recited in claim 1 including a digital to analog converter connected to receive digital data included in said first receiver output signal and produce a voice signal therefrom which voice signal is provided to said audio transducer.

7. A radio receiving apparatus as recited in claim 1 wherein said digital tuner control comprises a microprocessor and said microprocessor receives digital data from said second receiver output signal and sends digital data to a digital to analog converter.

8. A radio receiving apparatus as recited in claim 1 wherein said common entity is an automobile which participates in a race.

9. A radio receiving apparatus as recited in claim 1 wherein said common entity is an automobile which participates in a race, said audible sound is a voice transmission from a driver of said automobile and said display includes information relating to performance of said automobile in said race.

10. A radio receiving apparatus as recited in claim 1 wherein said common entity is an automobile which participates in a race and said display includes an illustration of the location of said automobile on a race track.

11. A radio receiving apparatus as recited in claim 1 wherein said common entity is an automobile which participates in a race and said display includes a graphic image illustrating the current speed and engine rpm of the automobile.

12. A radio receiving apparatus for use in conjunction with a portable electronic device having a display screen, comprising:

a first radio receiver for receiving audio signals, a second radio receiver for receiving data signals, a memory for storing therein a first radio frequency and a second radio frequency wherein said first radio frequency and said second radio frequency relate to a common entity, a digital tuner control connected to said memory for tuning said first radio receiver to said first frequency for producing a first receiver output signal and for tuning said second radio receiver to said second radio frequency for producing a second receiver output signal, wherein said first radio receiver and said second radio receiver operate concurrently, an output terminal coupled to receive said first receiver output wherein said first receiver output signal is a voice signal, and an electrical connector coupled to receive said second receiver output signal, said connector adapted for electrical connection to said portable electronic device, wherein said second receiver output signal includes data for producing a display on the display screen of said portable electronic device, wherein said voice signal and said display relate to said common entity.

13. A radio receiving apparatus as recited in claim 12 including an input port for receiving said radio frequencies for storage in said memory.

14. A radio receiving apparatus as recited in claim 12 including an infrared input port for receiving said radio frequencies for storage in said memory.

15. A radio receiving apparatus as recited in claim 12 including a keypad for providing said radio frequencies for storage in said memory.

16. A radio receiving apparatus as recited in claim 12 including a speaker connected to receive said voice signal.

17. A radio receiving apparatus as recited in claim 12 wherein said display includes both text and graphics.

18. A radio receiving apparatus as recited in claim 12 including a digital to analog converter connected to receive digital data included in said first receiver output signal and produce a voice signal therefrom.

19. A radio receiving apparatus as recited in claim 12 wherein said digital tuner control comprises a microprocessor and said microprocessor receives digital data from said second receiver output signal and sends digital data to a digital to analog converter.

20. A radio receiving apparatus as recited in claim 12 wherein said common entity is an automobile which participates in a race.

21. A radio receiving apparatus as recited in claim 12 wherein said common entity is an automobile which participates in a race, said voice signal is a voice transmission from a driver of said automobile and said display includes information relating to performance of said automobile in said race.

22. A radio receiving apparatus as recited in claim 12 wherein said common entity is an automobile which participates in a race and said display includes an illustration of the location of said automobile on a race track.

23. A radio receiving apparatus as recited in claim 12 wherein said common entity is an automobile which participates in a race and said display includes a graphic image illustrating the current speed and engine rpm of the automobile.

24. A method for producing multiple mode information to the user of a radio receiving apparatus, comprising the acts of:

storing in a memory of said apparatus a first radio frequency and a second radio frequency wherein said first radio frequency and said second radio frequency relate to a common entity, tuning a first radio receiver to said first frequency for receiving a data signal, tuning a second radio receiver to said second frequency for receiving an audio signal, wherein said first radio receiver and said second radio receiver operate concurrently, generating a display signal from said data signal, applying said audio signal to an audio transducer for producing an audible sound from said audio signal, and applying said display signal to a display screen for producing a display thereon, wherein said audible sound and said display relate to said common entity.

25. A method for producing multiple mode information as recited in claim 24 wherein said act of generating a display signal from said data signal comprises generating a display which includes text and graphics.

* * * * *